US009074759B2

(12) United States Patent
Lai

(10) Patent No.: US 9,074,759 B2
(45) Date of Patent: Jul. 7, 2015

(54) CANDLE STAND WITH FAUX FLAME

(71) Applicant: Wen-Cheng Lai, Hsinchu County (TW)

(72) Inventor: Wen-Cheng Lai, Hsinchu County (TW)

( * ) Notice: Subject to any disclaimer, the term of this patent is extended or adjusted under 35 U.S.C. 154(b) by 332 days.

(21) Appl. No.: 13/751,643

(22) Filed: Jan. 28, 2013

(65) Prior Publication Data

US 2014/0211458 A1 Jul. 31, 2014

(51) Int. Cl.

| | |
|---|---|
| ***F21V 35/00*** | (2006.01) |
| ***F21S 6/00*** | (2006.01) |
| *F21Y 101/02* | (2006.01) |

(52) U.S. Cl.

CPC ..... *F21V 35/00* (2013.01); *F21S 6/001* (2013.01); *F21Y 2101/02* (2013.01)

(58) Field of Classification Search

CPC ..... F21V 35/00; F21S 6/001; F21Y 2101/00; F21Y 2101/02

USPC ..... 362/392, 810

See application file for complete search history.

(56) References Cited

U.S. PATENT DOCUMENTS

| | | | | |
|---|---|---|---|---|
| 4,510,556 | A * | 4/1985 | Johnson | 362/184 |
| 5,600,209 | A * | 2/1997 | St. Louis | 315/200 A |
| 6,132,059 | A * | 10/2000 | Leibowitz | 362/156 |
| 7,083,295 | B1 * | 8/2006 | Hanna | 362/84 |
| 7,670,035 | B2 * | 3/2010 | Tsai | 362/392 |
| 7,862,397 | B1 * | 1/2011 | Ng et al. | 446/71 |
| 8,132,936 | B2 * | 3/2012 | Patton et al. | 362/249.02 |
| 2001/0036074 | A1 * | 11/2001 | Wang | 362/156 |
| 2003/0198045 | A1 * | 10/2003 | Kitchen | 362/235 |
| 2014/0177212 | A1 * | 6/2014 | Li | 362/190 |

* cited by examiner

*Primary Examiner* — Ali Alavi
(74) *Attorney, Agent, or Firm* — Rabin & Berdo, P.C.

(57) ABSTRACT

A candle stand with faux flame is disclosed, including a lamp stand, power supply, support frame, holder, flame decorative element, light-emitting body, motor, driving element, first resistive magnet body, and at least a second resistive magnet body. The support frame is fixedly standing upon lamp stand; the flame decorative element is suspended at top of holder; the light-emitting body emits light towards flame decorative element. The power supply and motor are inside lamp stand for driving the driving element. The first resistive magnet body is disposed at lower end of flame decorative element. The second resistive magnet body is disposed on the driving element. When the motor drives the driving element, the second resistive magnet body moves close to or away from first resistive magnet body so as to sway flame decorative element. With projected light, the swaying flame decorative element emulates a flame.

7 Claims, 7 Drawing Sheets

CANDLE STAND WITH FAUX FLAME

FIELD OF THE INVENTION

The present invention generally relates to a lamp technique, and more specifically to a lamp with visual effect of faux flame.

BACKGROUND OF THE INVENTION

While the traditional candle and oil-lamp are no longer in wide use, the traditional meaning and unique ambience associated with candle and oil lamp are still irreplaceable by the modern light bulb lamp; in particular, in many religious rituals, burning incense, candle or oil lamp is still considered as part of the important auspicious offering for spiritual cleansing. In addition, the flickering flame on the candle stick or oil lamp is considered to have a calming effect to soothe the weariness and fatigue for various occasions. However, as the candle and oil lamp poses potential danger if not carefully handled, the lamps with faux flame are developed.

The known lamp with faux flame is usually made into a shape of candle stand, with a flame-shape shade or bulb. A light-emitting body is placed inside the flame-shaped shade or bulb. When supplied with power, the light-emitting body inside the flame-shaped shade or bulb will emit light and the light radiates from the flame-shaped shade or bulb to create a visual effect of the lighted flame. However, as the flame created by the flame-shaped shade or bulb appears fixed, the visual effect is far from satisfactory to emulate the realistic effect of an actual flame.

Thus, it is desirable to devise a lamp with realistic faux flame to replace the actual candle and oil lamp while maintenance realistic visual result.

SUMMARY OF THE INVENTION

The primary object of the present invention is to provide a lamp with realistic faux flame to replace the actual candle and oil lamp while maintenance realistic visual result.

To achieve the above object, the present invention provides a candle stand with faux flame, including a lamp stand, a power supply, a support frame, a holder, a flame decorative element, a light-emitting body, a motor, a driving element, a first resistive magnet body, and at least a second resistive magnet body. The power supply is disposed inside the lamp stand; the support frame is fixedly standing upon the lamp stand; the holder is fixedly connected to the top of the support frame and having a vertical via hole; the flame decorative element penetrating the via hole and protruding beyond the top of the holder; the light-emitting body is fixed to the holder and emits light towards the direction of the flame decorative element. The light-emitting body is electrically connected to the power supply. The first resistive magnet body is disposed at the lower end of the flame decorative element. The motor is fixed to the lamp stand and is electrically connected to the power supply. The driving element is connected to the output end of the motor. The second resistive magnet body is disposed on the driving element. At least one of the first resistive magnet body and the second resistive magnet body is magnetic. The motor drives the driving element, which in turn drives the second resistive magnet body to move close to or away from the first resistive magnet body so that the flame decorative element will sway.

Compared to known technique, the present invention includes a flame decorative element on the holder and a light-emitting body fixed to the holder to emit light towards the flame decorative element, when the current runs through the light-emitting body, the light is emitted to the flame decorative element to form visual effect of a flame. In addition, because of the first resistive magnet body fixed to the lower end of the flame decorative element and the second resistive magnet body fixed to the driving element, the motor drives the driving element to rotate, which leads to the driving element moving the second resistive magnet body so that the second resistive magnet body moves towards or away from the first resistive magnet body. With the magnetic attraction or repellence between the first resistive magnet body and the second resistive magnet body, the first resistive magnet body will sway, which causes the flame decorative element to sway to create the visual effect of a dancing flame.

Preferably, a coupling axis is disposed horizontally inside the vertical via hole, and the flame decorative element is disposed with a coupling hole at the center segment so that the coupling axis passes through the coupling hole. As such, the flame decorative element is suspended on the coupling axis loosely so that the flame decorative element can move along the coupling axis as well as rotate around the coupling axis to create realistic visual effect of a flame.

Preferably, the driving element is a crank, with one end connected to the output end of the motor and the other end fixed to the second resistive magnet body. By the motor driving the one end of the crank, the other end of the crank can rotate around the axis of the output end of the motor. As such, the second resistive magnet body can perform circular motion to achieve the object of move towards to away from the first resistive magnet body.

Specifically, the crank includes a first segment, a second segment and a third segment. The first segment and the third segment are parallel, and the second segment is perpendicular to both the first segment and the third segment. With the crank formed by the first segment, second segment and third segment, the first segment and the third segment can support the second resistive magnet body so that the second resistive magnet body can be vertically closer to the first resistive magnet body. The second segment can translate the rotation of the third segment to revolution so that the location of the second resistive magnet body is changed to realize the object of being closer to or away from the first resistive magnet body.

Preferably, the driving element is a rotational axis and at least two leaves. The leaves are fixed to the upper end of the rotational axis, and the lower end of the rotational axis is connected to the output end of the motor. At least one of the second resistive magnet body is fixed to the surface of the leaves, preferably at location near the edge of the leaves and away from the rotational axis. The rotational axis is used to drive the leaves to rotate so that the location of the second resistive magnet body is changed to realize the object of being closer to or away from the first resistive magnet body. In addition, the wind caused by the rotation of the two leaves will blow through the via hole of the holder towards the flame decorative element to enhance the visual effect of the swaying flame.

Preferably, the first resistive magnet body and the second resistive magnet body are both permanent magnets. The permanent magnets do not require the electricity-excited magnetic field to cause magnetic force between the first resistive magnet body and the second resistive magnet body, which simplifies the structure as well as saves energy.

Specifically, the first resistive magnet body and the second resistive magnet body have opposite polarity. The attraction of the opposites causes the pulling of the first resistive magnet body when the second resistive magnet body moves closer to the first resistive magnet body so as to sway the flame decorative element.

Preferably, the candle stand with faux flame further includes a lamp shade. The lamp shape has a cylinder structure with opening at the top. The lamp shade covers on the outside of the lamp stand, the support frame and the holder. The flame decorative element passes through the opening and extends beyond the lamp shade. The lamp shade can provide protection to the lamp stand, the support frame and the holder, as well as additional aesthetic effect to enhance the realistic visual effect of a flame.

Preferably, the candle stand with faux flame further includes a gearbox, with an input end connected to the output end of the motor and an output end connected to the driving element. The gearbox is to reduce the output rotation speed of the motor so as to adjust the speed of the driving element and the swaying frequency of the flame decorative element to further enhance the realistic effect.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

The following refers to the drawings to describe the preferred embodiments of the present invention.

Figure 1:
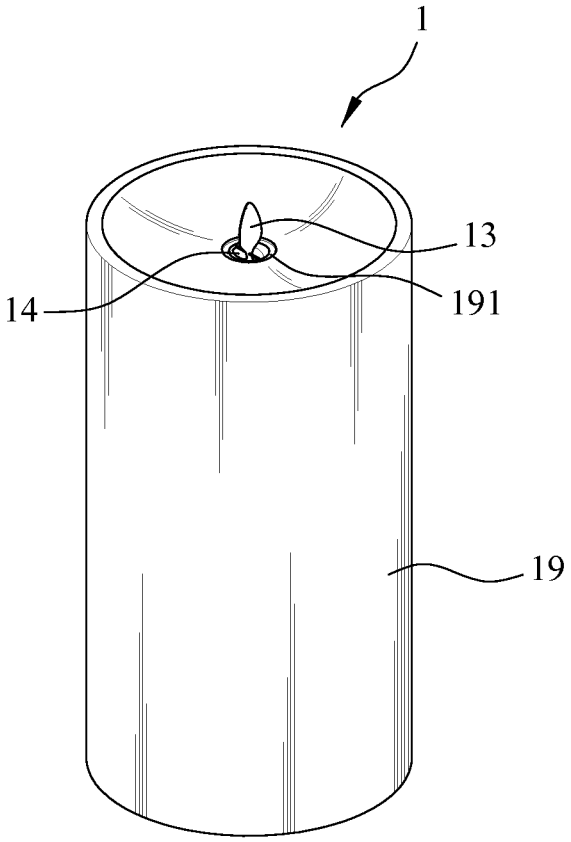
FIG. 1 shows a schematic view of a candle stand with faux flame of the first embodiment according to the present invention.
Figure 2:
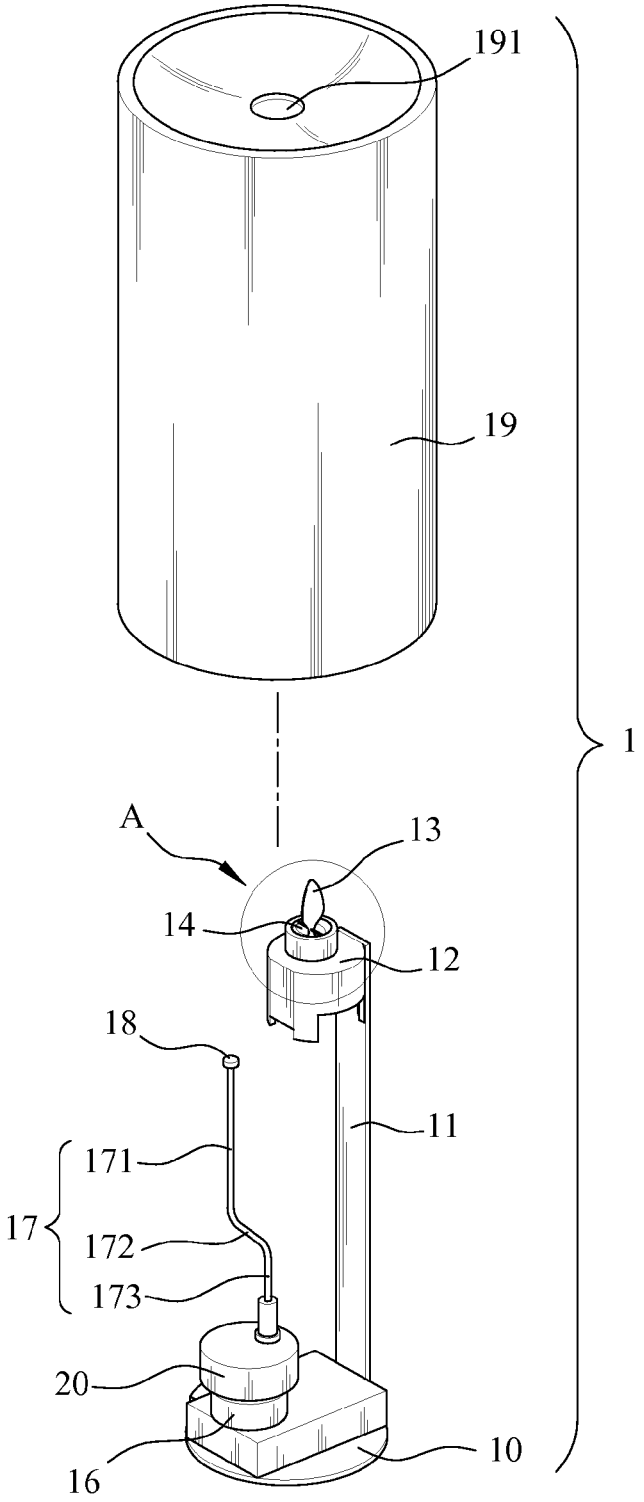
FIG. 2 shows a schematic view of a candle stand with faux flame of the first embodiment according to the present invention after the separation from the lamp shade.

As shown in FIG. 1 and FIG. 2, a candle stand with faux flame 1 of the present invention includes: a lamp stand 10, a support frame 11, a holder 12, a flame decorative element 13, a light-emitting body 14, a first resistive magnet body 15, a motor 16, a driving element 17, at least a second resistive magnet body 18, and a power supply (not shown). The candle stand with faux flame 1 may further include a lamp shade 19 and a gearbox 20. The light-emitting body 14 is a light-emitting diode (LED) of a bullet head shape. The first resistive magnet body 15 and the second resistive magnet body 18 are both permanent magnets.

Figure 3:
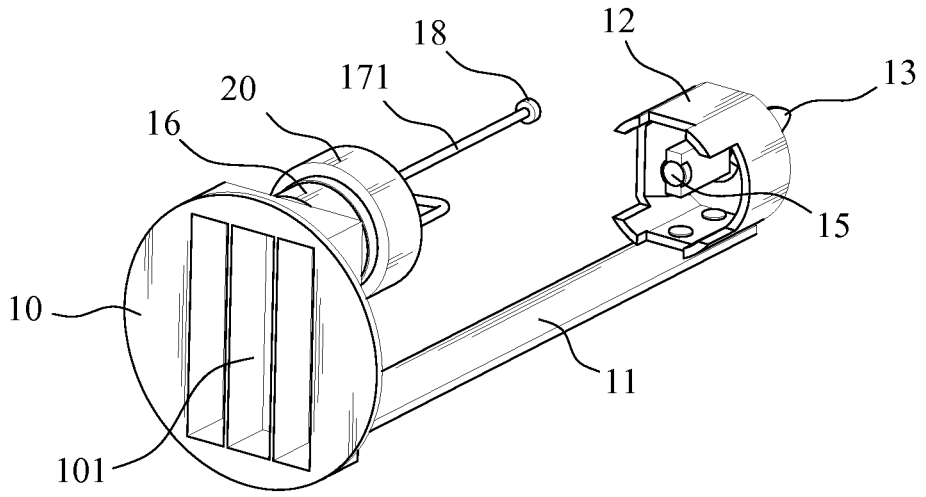
FIG. 3 is a schematic view from a different angle showing a candle stand with faux flame of the first embodiment according to the present invention after the separation of the lamp shade.

As shown in FIG. 3, the lamp stand 10 includes a battery chamber 101 at bottom for accommodating the power supply. The support frame 11 is fixedly standing upon the lamp stand 10. The holder 12 is fixedly connected to the top of the support frame 11. As shown in FIG. 3, the holder 12 includes a via hole 122, disposed vertically inside the holder 12. A coupling axis 121 is disposed horizontally inside the via hole 122.

Figure 4:
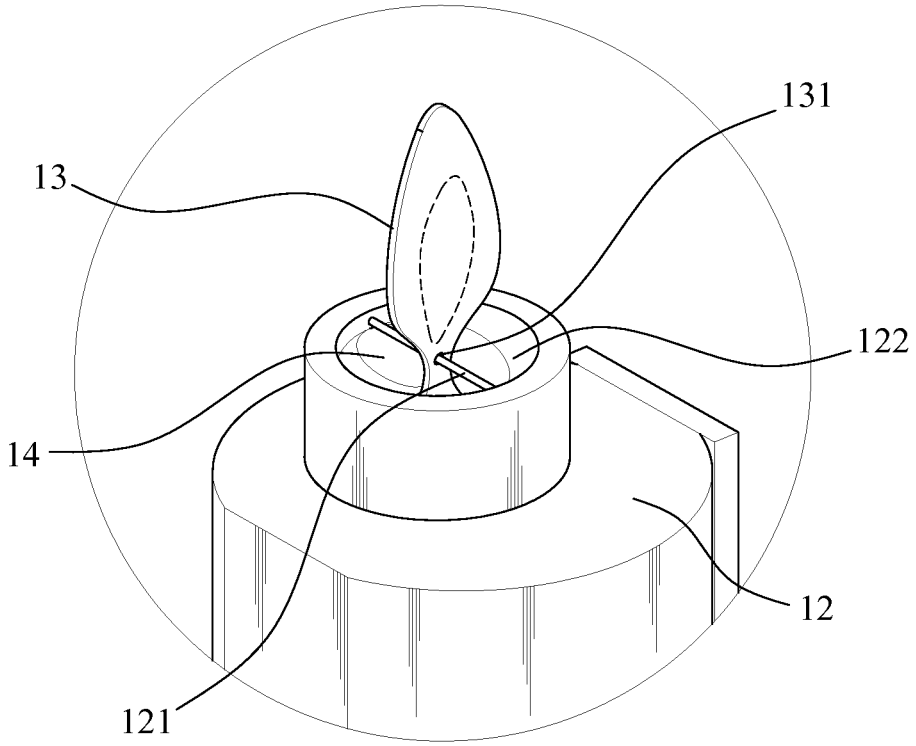
FIG. 4 is an enlarged view of A shown in FIG. 2.
Figure 5:
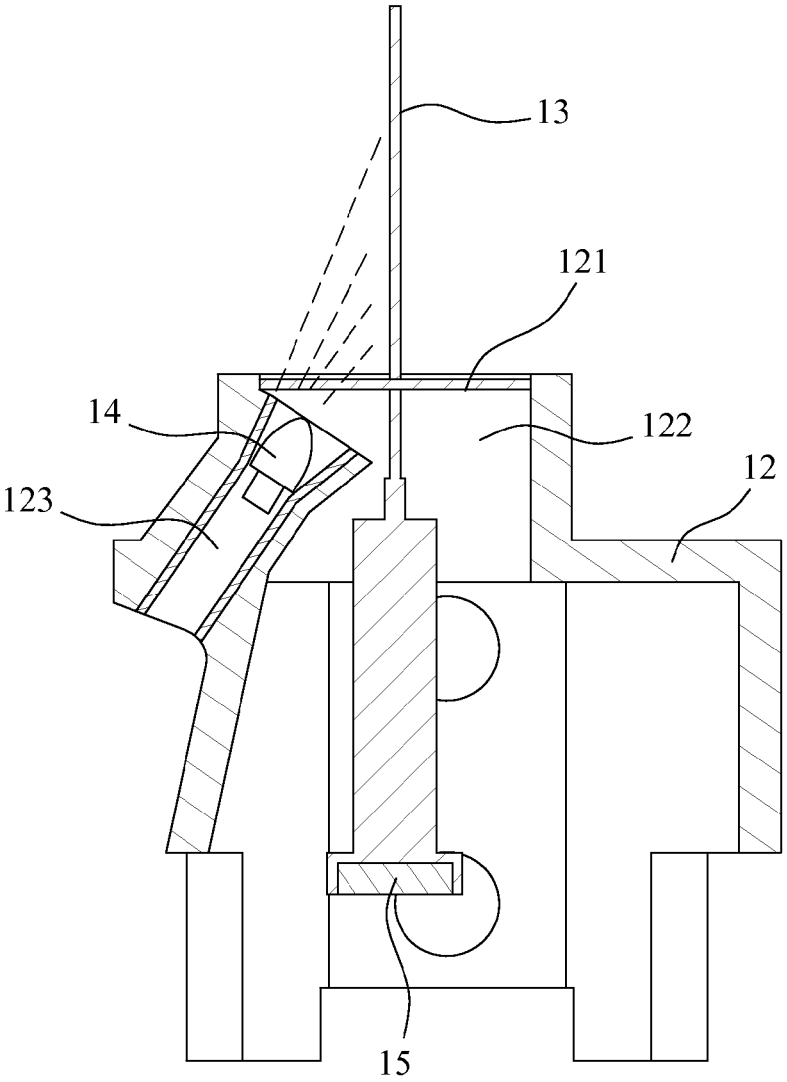
FIG. 5 shows a cross-sectional view of the holder of the candle stand with faux flame of the first embodiment according to the present invention.

Referring to FIG. 4 and FIG. 5, the flame decorative element 13 is disposed with a coupling hole 131 at the center segment so that the coupling axis 121 passes through the coupling hole 131 to couple the flame decorative element 13 with the via hole 122. As such, the flame decorative element 13 is suspended on the coupling axis 121 loosely so that the flame decorative element 13 can slide the coupling axis 121 as well as rotate around the coupling axis 121 to create realistic visual effect of a flame. The light-emitting body 14 is fixedly disposed inside a light trench 123 of the holder 12 and emits light towards the flame decorative element 13. Specifically, the light emitted by the light-emitting body 14 passes the via hole 122 and projects onto the side of the flame decorative element. The light-emitting body 14 is electrically connected to the power supply. By using the light-emitting body 14 with light color close to the actual flame to project light onto the flame decorative element 13, the realistic visual effect of a flame can be achieved. The first resistive magnet body is disposed at the lower end of the flame decorative element 13.

Figure 6:
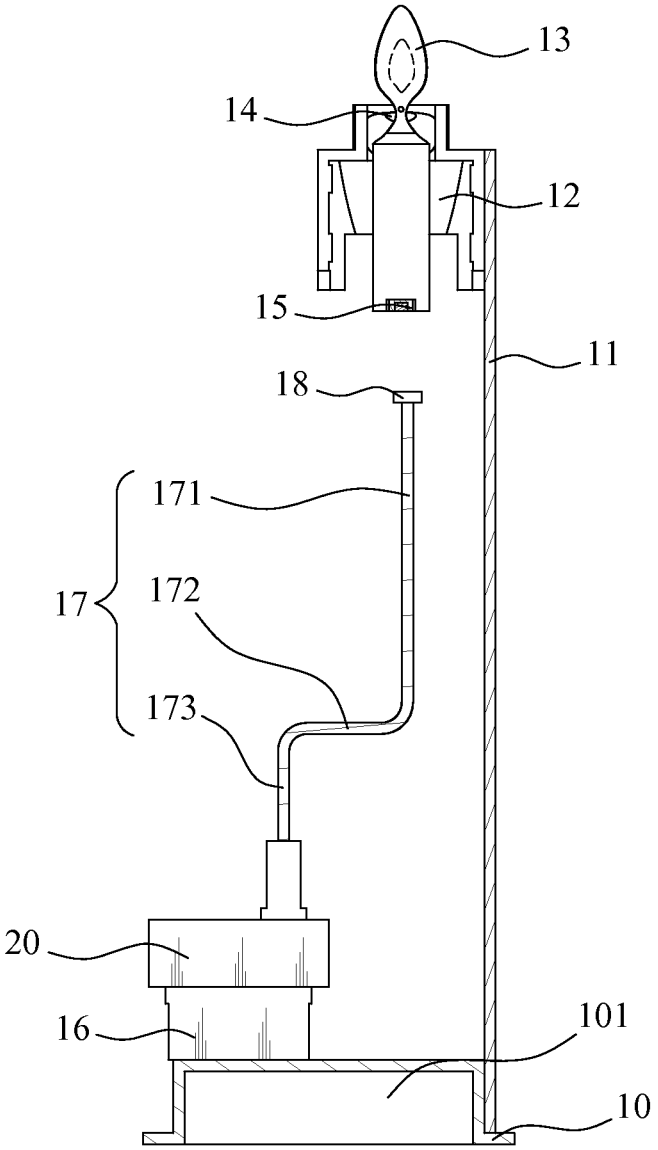
FIG. 6 shows a cross-sectional view of the candle stand with faux flame of the first embodiment according to the present invention.

Combining the above description and referring to FIG. 6, the motor 16 is fixed to the lamp stand 16 and electrically connected to the power supply. The input end of the gearbox 20 is connected to the output end of the motor 16, and the output end of the gearbox 20 is connected to the driving element 17. In the present embodiment, the driving element 17 is a crank, with one end connected to the output end of the gearbox 20 and the other end connected fixedly to the second resistive magnet body 18. Specifically, the crank includes a first segment 171, a second segment 172 and a third segment 173. The first segment 171 and the third segment 173 are parallel, and the second segment 172 is perpendicular to both the first segment 171 and the third segment 173. The third segment 173 is connected to the output end of the gearbox 20. The upper end of the first segment 171 is disposed with the second resistive magnet body 18. With the crank formed by the first segment 171, second segment 172 and third segment 173, the first segment 171 and the third segment 173 can support the second resistive magnet body 18 so that the second resistive magnet body 18 can be vertically closer to the first resistive magnet body 15. The second segment 172 can translate the rotation of the third segment 173 to revolution of the first segment 171 so that the location of the second resistive magnet body 18 is changed to realize the object of being closer to or away from the first resistive magnet body 15.

Figure 7:
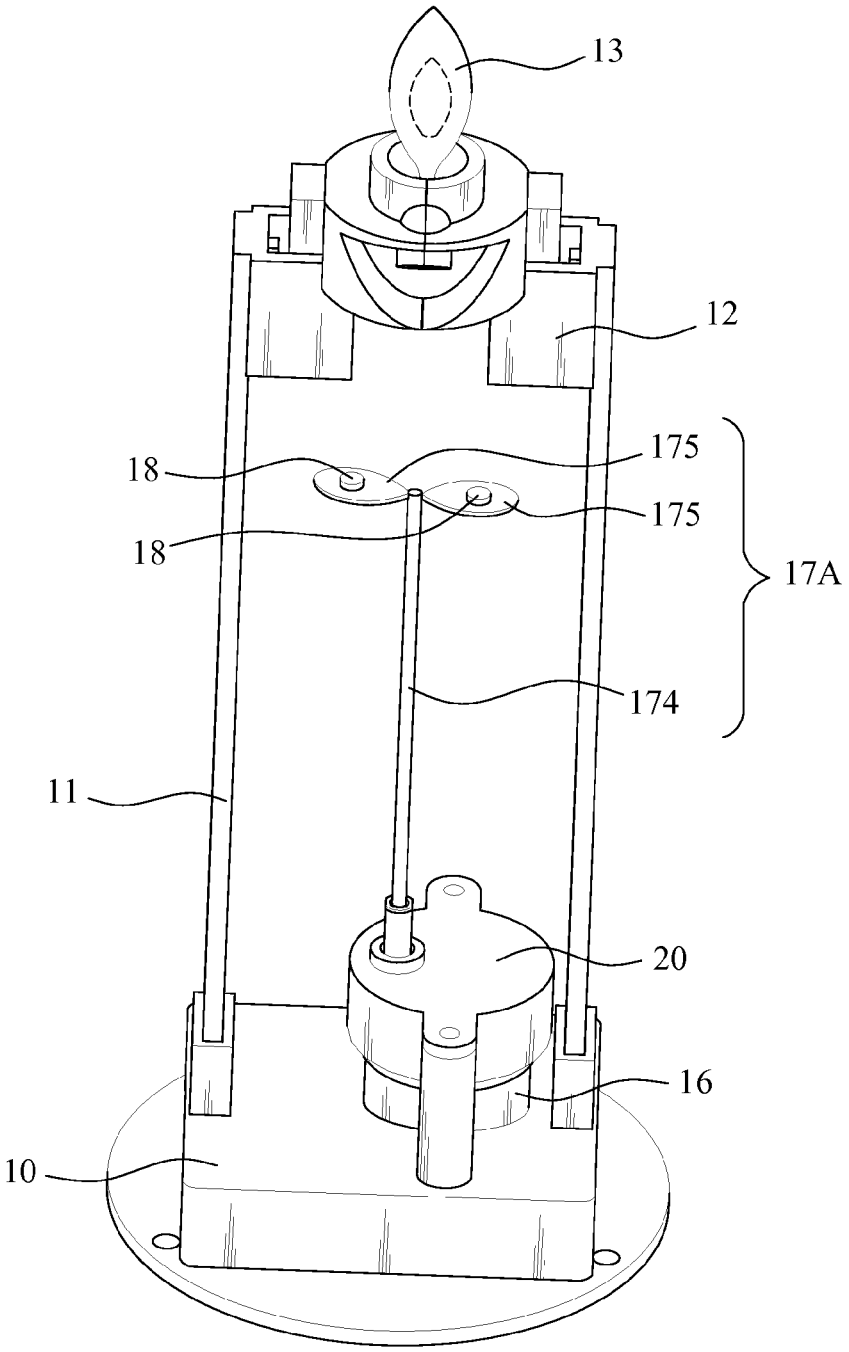
FIG. 7 is a schematic view showing the structure of the candle stand with faux flame of the second embodiment according to the present invention.

FIG. 7 shows the second embodiment of the present invention. In this embodiment, the driving element 17A includes a rotational axis 174 and at least two leaves 175. The leaves 175 are fixed to the upper end of the rotational axis 174, and the lower end of the rotational axis 174 is connected to the output end of the gearbox 20. At least one of the second resistive magnet bodys 18 is fixed to the surface of the leaves 175, preferably at location near the edge of the leaves 175 and away from the rotational axis 174. In the present embodiment, a second resistive magnet body 18 is fixed to each leaf 175. The rotational axis 174 is used to drive the leaves 175 to rotate so that the location of the second resistive magnet body 18 is changed to realize the object of being closer to or away from the first resistive magnet body 15. In addition, the wind caused by the rotation of the two leaves 174 will blow through the via hole 122 of the holder 12 towards the flame decorative element 13 to enhance the visual effect of the swaying flame. The driving element can also be of other forms, such as, swinging element. Driven by motor 16, a swinging element can swing to realize the second resistive magnet body 18 be closer to or away from the first resistive magnet body 15.

The first resistive magnet body 15 and the second resistive magnet body 18 are both permanent magnets. The permanent magnets do not require the electricity-excited magnetic field to cause magnetic force between the first resistive magnet body 15 and the second resistive magnet body 18, which simplifies the structure as well as saves energy. Specifically, the first resistive magnet body and the second resistive magnet body have the same polarity so that the magnetic repellence will cause the flame decorative element 13 to sway, or opposite polarity so that the magnetic attraction will also cause the flame decorative element 13 to sway. Alternatively, one of the first resistive magnet body and the second resistive magnet body is a permanent magnet and the other is made of material attracted by the magnetic force, such as, Fe, Co, or Ni, so as to sway the flame decorative element.

Referring to FIG. 1 and FIG. 2 again. The lamp shade 19 has a cylinder structure with an opening 191 at the top. The lamp shade 19 covers on the outside of the lamp stand 10, the support frame 11 and the holder 12. The flame decorative element 13 passes through the opening 191 and extends beyond the lamp shade 19. The lamp shade 19 can provide protection to the lamp stand 10, the support frame 11 and the holder 12, as well as additional aesthetic effect to enhance the realistic visual effect of a flame.

The light-emitting body 14 can also use different color to achieve different effect. Similarly, the lamp shade 19 can also be designed with different appearance to emulate real object to enhance the visual effect.

In summary, by switching on the candle stand with faux flame 1, the light-emitting body 14 emits light and projects onto the flame decorative element 13. In the mean time, the motor 16 rotates to rotate the crank of the driving element 17 through gearbox 20. The first segment 171 of the crank revolves to move the second resistive magnet body 18 in circular motion to periodically move closer to and ways from the first resistive magnet body 15. When the second resistive magnet body 18 moves to beneath the first resistive magnet body 15, the magnetic force between the first resistive magnet body 15 and the second resistive magnet body 18 will cause the flame decorative element 13 to sway to emulate the an actual flame dancing by the airflow.

Because of a flame decorative element 13 on the holder 12 and a light-emitting body 14 fixed to the holder 12 to emit light towards the flame decorative element 13, when the current runs through the light-emitting body 14, the light is emitted to the flame decorative element 13 to form visual effect of a flame. In addition, because of the first resistive magnet body 15 fixed to the lower end of the flame decorative element 13 and the second resistive magnet body 18 fixed to the first segment 171 of the driving element 17, the motor drives the driving element 17 to rotate, which leads to the driving element 17 moving the second resistive magnet body 18 so that the second resistive magnet body 18 moves towards or away from the first resistive magnet body 15. With the magnetic attraction or repellence between the first resistive magnet body 15 and the second resistive magnet body 18, the first resistive magnet body 15 will sway, which causes the flame decorative element 13 to sway to create the visual effect of a dancing flame.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A candle stand with faux flame, comprising:

a lamp stand, a support frame, a holder, a flame decorative element, a light-emitting body, a first resistive magnet body, and a power supply; wherein the power supply being disposed inside the lamp stand;

the support frame being fixedly standing upon the lamp stand;

the holder being fixedly connected to the top of the support frame and having a vertical via hole; the flame decorative element penetrating the via hole and protruding beyond the top of the holder;

the light-emitting body being fixed to the holder and emitting light towards the direction of the flame decorative element;

the light-emitting body being electrically connected to the power supply;

the first resistive magnet body being disposed at the lower end of the flame decorative element;

the candle stand with faux flame further comprising:

a motor, a driving element and at least a second resistive magnet body, the motor being fixed to the lamp stand and being electrically connected to the power supply;

the driving element being connected to the output end of the motor;

the second resistive magnet body being disposed on the driving element;

at least one of the first resistive magnet body and the second resistive magnet body being magnetic;

the motor driving the driving element, which in turn driving the second resistive magnet body to move close to or away from the first resistive magnet body;

the driving element comprising a rotational axis and at least two leaves;

the leaves being fixed to the upper end of the rotational axis, the lower end of the rotational axis being connected to the output end of the motor;

the at least a second resistive magnet body being fixed to at least one of the leaves, and the at least a second resistive magnet body fixed to the leaves having a motion path not intersecting with a vertical line passing through the first resistive magnet body and perpendicular to the horizontal ground.

2. The candle stand with faux flame as claimed in claim 1, wherein a coupling axis is disposed horizontally inside the vertical via hole;

the flame decorative element is disposed with a coupling hole at the center segment; and the coupling axis passes through the coupling hole.

3. The candle stand with faux flame as claimed in claim 1, wherein the first resistive magnet body and the second resistive magnet body are both permanent magnets.

4. The candle stand with faux flame as claimed in claim 3, wherein the first resistive magnet body and the second resistive magnet body have the same polarity.

5. The candle stand with faux flame as claimed in claim 3, wherein the first resistive magnet body and the second resistive magnet body have opposite polarity.

6. The candle stand with faux flame as claimed in claim 1, further comprising:

a lamp shade, the lamp shape having a cylinder structure with opening at the top, covering on the outside of the lamp stand, the support frame and the holder, and the flame decorative element passing through the opening and extending beyond the lamp shade.

7. The candle stand with faux flame as claimed in claim 1, further comprising:

a gearbox, with an input end connected to the output end of the motor and an output end connected to the driving element.

* * * * *